US009764570B2

(12) United States Patent
Kondo

(10) Patent No.: US 9,764,570 B2
(45) Date of Patent: Sep. 19, 2017

(54) SHEET FEEDING APPARATUS

(71) Applicant: CANON KABUSHIKI KAISHA, Tokyo (JP)

(72) Inventor: Takashi Kondo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/208,812

(22) Filed: Jul. 13, 2016

(65) Prior Publication Data

US 2017/0021647 A1 Jan. 26, 2017

(30) Foreign Application Priority Data

Jul. 21, 2015 (JP) ..... 2015-143750
May 10, 2016 (JP) ..... 2016-094913

(51) Int. Cl.

*G03G 15/00* (2006.01)
*B41J 13/10* (2006.01)
*B65H 1/04* (2006.01)
*B41J 17/02* (2006.01)

(52) U.S. Cl.

CPC ..... *B41J 13/10* (2013.01); *B65H 1/04* (2013.01); *G03G 15/6502* (2013.01); *G03G 15/6508* (2013.01); *B41J 17/02* (2013.01); *G03G 15/6511* (2013.01); *G03G 15/6529* (2013.01); *G03G 15/6547* (2013.01)

(58) Field of Classification Search

CPC ..... B41J 13/0009; B41J 13/10; B41J 17/02; G03G 15/6547; G03G 15/6511; G03G 15/6529; G03G 15/6502; G03G 15/6508; B65H 1/04

See application file for complete search history.

(56) References Cited

U.S. PATENT DOCUMENTS 3,861,667 A * 1/1975 Jahme ..... B65H 5/12 271/11
6,000,689 A * 12/1999 Furuki ..... B65H 3/5261 271/10.11
6,332,609 B1 * 12/2001 Arakawa ..... B65H 1/04 271/157
6,390,462 B1 * 5/2002 Ouchi ..... B65H 3/0669 271/109
2006/0220297 A1 * 10/2006 Kusumi ..... B65H 3/0669 271/10.01
2012/0027484 A1 * 2/2012 Wang ..... G03G 15/6541 399/410

FOREIGN PATENT DOCUMENTS

JP 2005-060054 A 3/2005

* cited by examiner

*Primary Examiner* — Manish S Shah
*Assistant Examiner* — Yaovi M Ameh
(74) *Attorney, Agent, or Firm* — Fitzpatrick, Cella, Harper & Scinto

(57) ABSTRACT

A sheet feeding apparatus includes a first sheet storage portion and a second sheet storage portion disposed side by side with the first sheet storage portion. The sheet feeding device includes a sheet bundle moving member configured to transfer sheets in the second sheet storage portion to the first sheet storage portion and a pickup roller configured to feed the sheet by abutting against the sheet stored in the first sheet storage portion. When transferring the sheet bundle in the second sheet storage portion to the first sheet storage portion, the pickup roller is rotated in the same direction as that during feeding.

15 Claims, 11 Drawing Sheets

SHEET FEEDING APPARATUS

BACKGROUND OF THE INVENTION

Field of the Invention

This disclosure relates to a sheet feeding apparatus for feeding a sheet and an image forming apparatus including the sheet feeding apparatus.

Description of the Related Art

Hitherto, in an image forming apparatus such as a copier, a printer, and a facsimile apparatus, a type including a sheet storage portion that is able to be mounted and pulled out from a front side of an image forming apparatus body is known. In order to increase the storage amount of sheets of a size that is frequently used, for example, such as an A4 size in a limited space, as illustrated in JP-A-2005-60054, there is an image forming apparatus including a tandem type sheet feeding apparatus in which sheet storage portions are disposed in parallel in a lateral direction.

As the sheet feeding apparatus, a sheet feeding apparatus including a first storage portion in which sheets are stacked, a feeding roller which feeds the sheets from the first storage portion, and a second storage portion which is disposed in a horizontal direction of the first storage portion is proposed. The sheet feeding apparatus includes a configuration of collectively transferring the sheets within the second storage portion to the first storage portion by a back fence (pressing plate) if the sheets stored in the first storage portion are fed and are depleted.

In a certain conventional sheet feeding apparatus, in a case in which a top sheet of sheets stored in the second storage portion is curled, there is a concern that the following problems may occur. That is, there is a concern that the top sheet of the second storage portion collides with the feeding roller in a condition in which a sheet bundle is transferred by the back fence. In this case, a path of the sheet colliding with the feeding roller is changed and the sheet may not be transferred to the first storage portion. Even if the sheet is transferred to the first storage portion, a disadvantage such as a leading end being damaged occurs and when feeding of the sheet is started by lifting a bottom plate of the first storage portion after completing the transfer, the possibility of a jam (sheet jam) occurring is increased.

SUMMARY OF THE INVENTION

According to one aspect of this disclosure, there is provided a sheet feeding apparatus including a casing, a first sheet storage portion configured to be movably provided to a mounting position and a pull-out position with respect to the casing, a second sheet storage portion configured to be disposed side by side with the first sheet storage portion and to be movably provided to the mounting position and the pull-out position with respect to the casing, a sheet transfer portion configured to be able to transfer a sheet bundle stored in the second sheet storage portion to the first sheet storage portion when the first sheet storage portion and the second sheet storage portion are in the mounting position, a rotator configured to feed the sheet by being rotated while abutting against the sheet stored in the first sheet storage portion, and a control portion configured to drive the sheet transfer portion when transferring the sheet bundle of the second sheet storage portion to the first sheet storage portion by the sheet transfer portion and to control the rotator to be rotated in the same rotation direction as when feeding the sheet.

Further features of the present invention will become apparent from the following description of exemplary embodiments with reference to the attached drawings.

DESCRIPTION OF THE EMBODIMENTS

Embodiments described below provide a sheet feeding apparatus that is able to transfer sheets to a first sheet storage portion side without damaging a leading end of the sheet even if a top portion of the sheets stored in a second sheet storage portion is curled and an image forming apparatus.

First Embodiment

Figure 1:
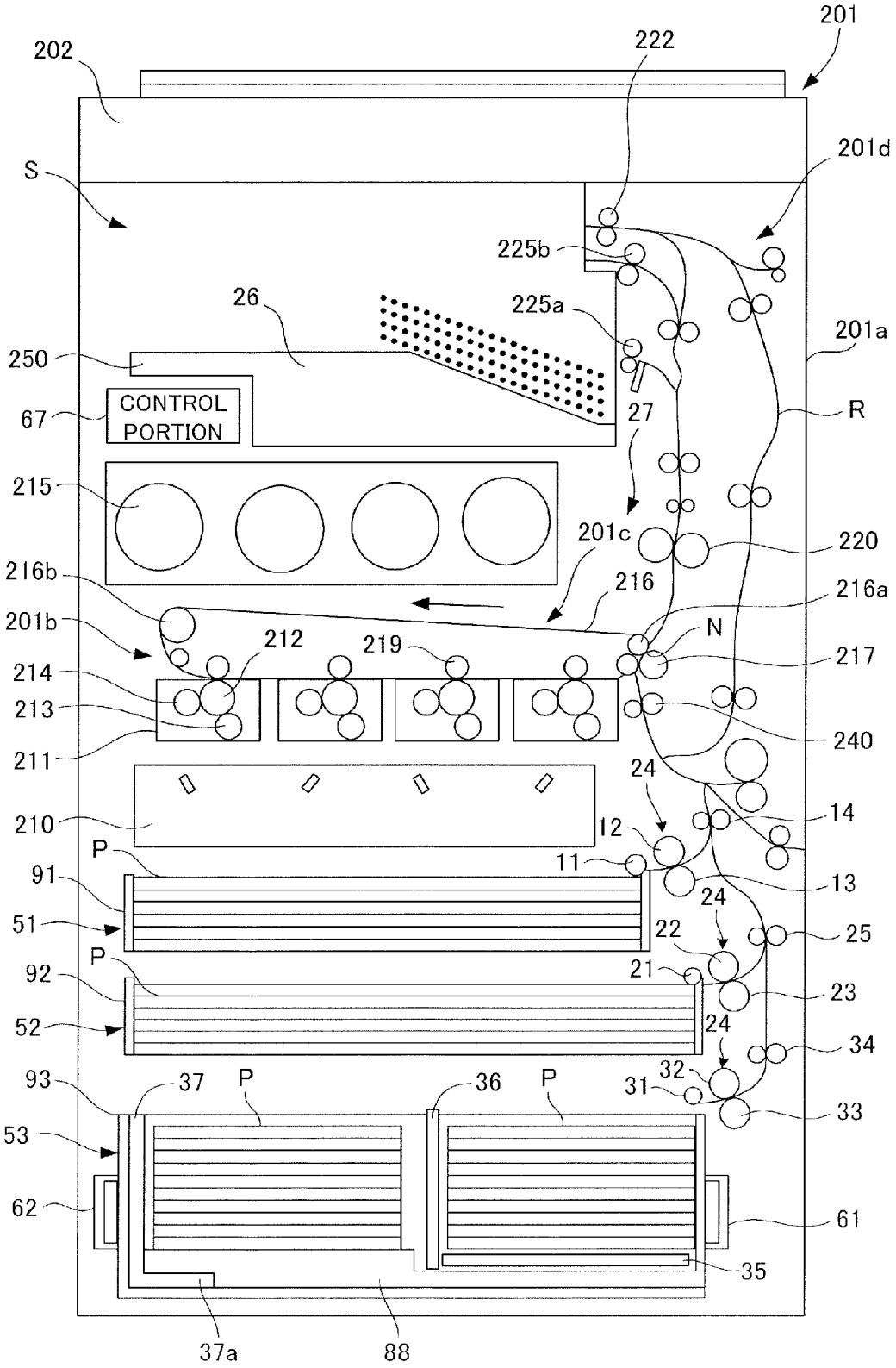
FIG. 1 is a schematic view illustrating a laser beam printer as an image forming apparatus according to a first embodiment of this disclosure.

Hereinafter, a first embodiment of this disclosure will be described with reference to the drawings. First, an image forming apparatus including a sheet feeding apparatus according to the embodiment will be described with reference to FIG. 1. FIG. 1 is a schematic view illustrating a state in which a laser beam printer is viewed from the front. It is noted that this disclosure is also able to be executed in another form in which a part of or all of the configurations of the embodiment are replaced with an alternative configuration. This disclosure can be executed for various applications such as a printer, various printing machines, a copier, a FAX, and a complex machine by adding a necessary device, equipment, and a casing structure.

Image Forming Apparatus

As illustrated in FIG. 1, a laser beam printer 201 of full-color as an image forming apparatus includes an image forming apparatus body (hereinafter, referred to as an apparatus body) 201*a*. The apparatus body 201*a* has a control portion 67 for controlling each portion of the apparatus, an image forming portion 201*b*, a fixing portion 220, and an image reading device 202 that is substantially horizontally disposed above the apparatus body 201*a*.

A discharge space S for discharging a sheet below the image reading device 202 is provided in the apparatus body 201*a*. A toner cartridge 215 is disposed below the discharge space S and sheet feeding apparatuses 51, 52, and 53 are disposed on an under side within the apparatus body 201*a*. The sheet feeding apparatuses 51 and 52 are respectively configured to be able to mount and pull out sheet feeding cassettes 91 and 92 on and from the apparatus body 201*a*.

The sheet feeding apparatus 53 is configured to be able to mount and pull out the sheet feeding cassette 93 on and from the apparatus body 201*a*. The sheet feeding cassette 93 is able to take a mounting position in which the sheet feeding cassette 93 is mounted on the apparatus body 201*a* and a pull-out position in which the sheet feeding cassette 93 is pulled out from the apparatus body 201*a*.

The image forming portion 201*b* employs a four-drum full color type and has a laser scanner 210 and four process cartridges 211 forming a four-color toner image of yellow (Y), magenta (M), cyan (C), and black (K).

Here, each process cartridge 211 has a photoconductive drum 212, a charger 213, a developer 214, and a cleaner (not illustrated). In addition, the image forming portion 201*b* has an intermediate transfer unit 201*c* above the process cartridge 211.

The intermediate transfer unit 201*c* has an intermediate transfer belt 216 that is supported by a drive roller 216*a* and a tension roller 216*b*. In addition, the intermediate transfer unit 201*c* has a primary transfer roller 219 abutting against an inner surface of the intermediate transfer belt 216 at a position in which the primary transfer roller 219 faces the photoconductive drum 212. The intermediate transfer belt 216 abuts against each photoconductive drum 212 and is rotated in an arrow direction by the drive roller 216*a*.

A toner image of each color on the photoconductive drum 212 is sequentially multi-transferred to the intermediate transfer belt 216. Therefore, a color image is formed on the intermediate transfer belt. A secondary transfer roller 217 that transfers the color image formed on the intermediate transfer belt to a sheet P at a position in which the secondary transfer roller 217 faces the drive roller 216*a*. It is noted that a secondary transfer unit is configured of a secondary transfer nip portion N formed by the intermediate transfer belt 216 and the secondary transfer roller 217 that is in pressure contact with the intermediate transfer belt 216.

The fixing portion 220 is disposed on a downstream side of the secondary transfer roller 217 in a direction of sheet conveyance and a first sheet discharge roller pair 225*a*, a second sheet discharge roller pair 225*b*, and a side reverse portion 201*d* are disposed above the fixing portion 220. The side reverse portion 201*d* has a reverse roller pair 222 that is rotatable in both directions, a re-conveyance path R that conveys again the sheet where an image is formed on a first surface to the image forming portion 201*b*, and the like. It is noted that an image forming unit 27, which forms an image on the sheet P delivered by the sheet feeding apparatuses 51, 52, and 53, is configured of the image forming portion 201*b*, the secondary transfer nip portion N, and the fixing portion 220.

The sheet feeding cassette 91 for storing the sheets P and a sheet feeding portion 24 for delivering the sheet P stored in the sheet feeding cassette 91 toward a drawing roller pair 14 on a downstream side corresponding thereto are disposed in the sheet feeding apparatus 51. In addition, the sheet feeding cassette 92 storing the sheets P and a sheet feeding portion 24, which delivers the sheet P stored in the sheet feeding cassette toward a drawing roller pair 25 on a downstream side corresponding thereto, are disposed in the sheet feeding apparatus 52.

A pickup roller 11, a conveyance roller 12, and a separating roller 13 are disposed in an upper portion of the downstream side in a sheet feeding direction in the sheet feeding portion 24 corresponding to the sheet feeding cassette 91. In addition, a pickup roller 21, a conveyance roller 22, and a separating roller 23 are disposed on an upper portion of the downstream side in the sheet feeding direction in the sheet feeding portion 24 corresponding to the sheet feeding cassette 92.

In addition, the sheet feeding cassette 93 for storing the sheets P and the sheet feeding portion 24 for delivering the sheet P stored in the sheet feeding cassette 93 toward a drawing roller pair 34 on the downstream side are disposed in the sheet feeding apparatus 53. A pickup roller 31, a conveyance roller 32, and a separating roller 33 are disposed in the upper portion of the downstream side in the sheet feeding direction in the sheet feeding portion 24 corresponding to the sheet feeding cassette 93.

The sheet feeding cassette 93 is supported to be mounted and pulled out on and from the apparatus body 201*a* along drawing rails 61 and 62 in a front-back direction in the view, and is movably disposed in a mounting position and a pull-out position with respect to the apparatus body 201*a*. The conveyance roller 32 is disposed on the downstream side in the sheet feeding direction by the pickup roller 31 and conveys the sheet fed by the pickup roller 31 further on the downstream side.

If an image forming operation is started, the sheets P are fed one by one from any one of the sheet feeding cassettes 91, 92, and 93 by the sheet feeding portion 24. The sheet P fed by any one of the pickup rollers 11, 21, and 31 is conveyed by one of the corresponding conveyance rollers 12, 22, and 32. In this case, if a plurality of sheets P are overlapped and delivered, the sheets P of a second sheet and sheets subsequent thereto are returned to the sheet feeding cassette side by one of the corresponding separating rollers 13, 23, and 33. One sheet P, which is conveyed on the downstream side, which is not returned to the sheet feeding cassette side, is delivered further to the downstream side by one of the corresponding drawing roller pairs 14, 25, and 34, and is conveyed to a registration roller pair 240. Hereinafter, a configuration and an operation of the sheet feeding apparatus 53 will be described in order. In the present specification, "the sheet is fed" means that the sheet stored in the first sheet storage portion is delivered by the pickup roller (rotator) to supply the sheet to the image forming portion.

"The sheet bundle is transferred" means that the sheet bundle stored in the second sheet storage portion moves to the first sheet storage portion in a state in which the sheets are not stored.

Configuration of Sheet Feeding Apparatus

The sheet feeding apparatus 53 according to the first embodiment will be described with reference to FIGS. 1 to 7B.

As illustrated in FIGS. 2A to 5, the sheet feeding apparatus 53 has the sheet feeding cassette 93 including a first sheet storage portion 55*a* on a right side in the view and a second sheet storage portion 55*b* on a left side in the view. The sheet feeding cassette 93 is supported on the apparatus body 201*a* to be mounted and pulled out with respect to the apparatus body 201*a*. In the embodiment, the sheet feeding cassette 93 is configured so as to integrally pull out the first sheet storage portion 55*a* and the second sheet storage portion 55*b*, but is not limited to the embodiment. The first sheet storage portion 55*a* and the second sheet storage portion 55*b* may be provided respectively independent from each other to be capable of pulling out. The sheets P are stored in the first sheet storage portion 55*a* and the sheets P are fed by the pickup roller 31 which is a rotator. The second sheet storage portion 55*b* is disposed so as to be adjacent to the first sheet storage portion 55*a* side by side in the horizontal direction and a sheet bundle P for being transferred to the first sheet storage portion 55*a* is stored in the second sheet storage portion 55*b*. The pickup roller 31 is supported so that a position in a height direction can be changed.

Sheets of which an amount of use is large, for example, such as an A4 size and a letter size are stored in the sheet feeding apparatus 53. In the sheet feeding apparatus 53, the sheets P within the first sheet storage portion 55*a* on the right side in the view are fed from above in order. Then, if the sheets P on the first sheet storage portion 55*a* side are depleted, the sheet feeding apparatus 53 is configured of a tandem cassette which transfers the sheet bundle P on the second sheet storage portion 55*b* side on the left side in the view to the first sheet storage portion 55*a* side and is able to restart the feeding operation to the image forming portion.

Figure 4A:
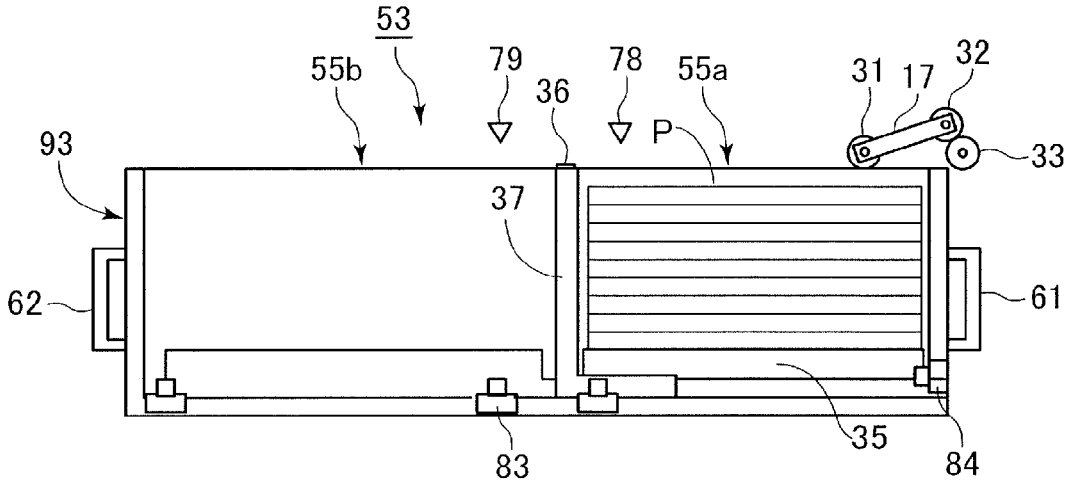
FIG. 4A is a schematic view illustrating a state in which transferring of the sheet bundle to the first sheet storage portion side is completed.
Figure 4B:
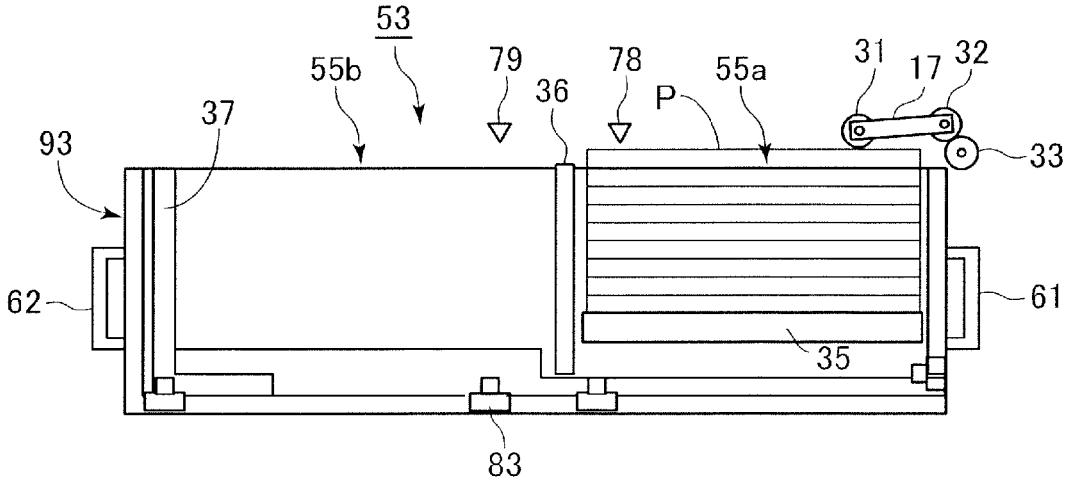
FIG. 4B is a schematic view illustrating a state in which a sheet bundle moving member returns to the second sheet storage portion side and the lifter plate is lifted.
Figure 5:
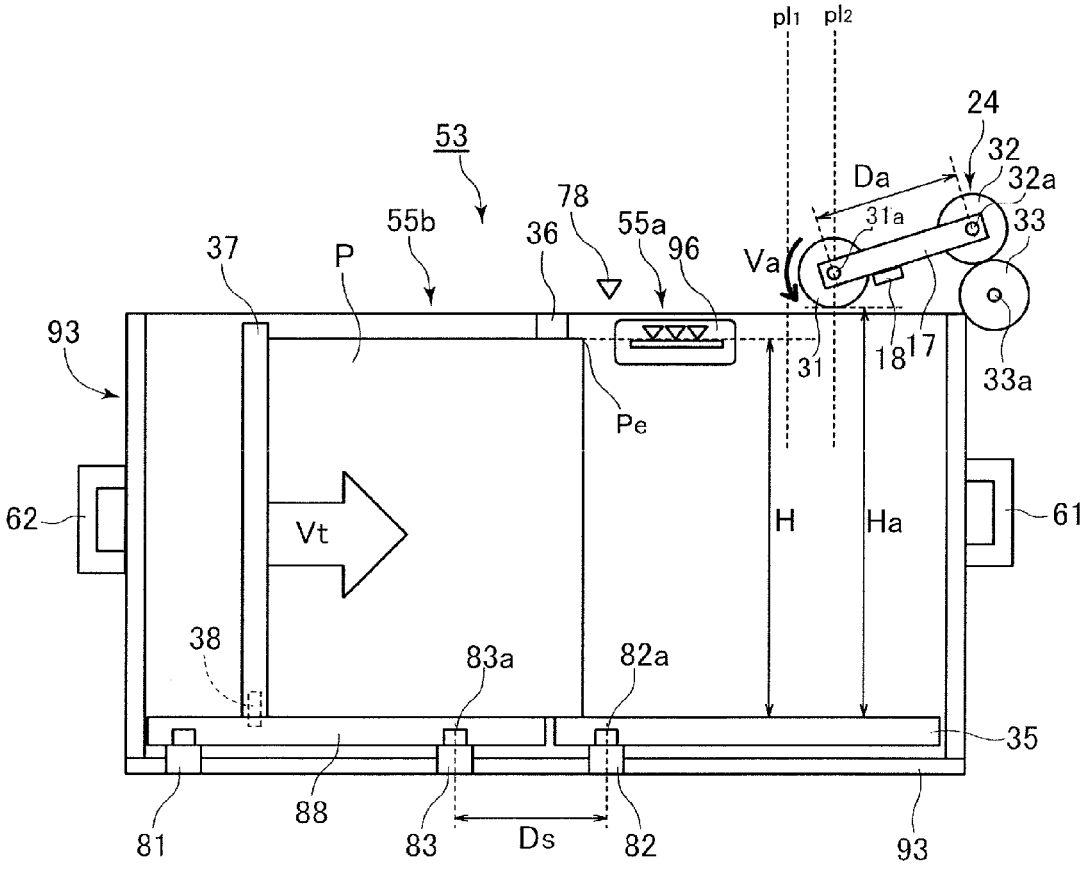
FIG. 5 is a schematic view illustrating a state in which the sheet bundle is transferred from the second sheet storage portion side to the first sheet storage portion side.

As illustrated in FIGS. 2A to 5, a lifter plate 35 for lifting and lowering the stacked sheets P is provided in the first sheet storage portion 55*a*. As illustrated in FIG. 5, the pickup roller (rotator) 31 disposed above the lifter plate is supported by a feeding holder (feeding support member) 17 to be pivotable around a rotation shaft 32*a* of the conveyance roller 32. The pickup roller 31 is configured so as to deliver the sheet in a direction of the conveyance roller 32 by being rotated while abutting against the sheet during the image formation. In this case, it is possible to rotate the pickup roller 31 by transmitting the rotation via a belt drive device and the like by rotating the conveyance roller 32. The delivered sheet P is conveyed by the conveyance roller 32, but if two or more sheets P are overlapped and delivered, the sheets P of the second sheet and sheets subsequent thereto are returned to the first sheet storage portion 55*a* by a separation operation by the conveyance roller 32 and the separating roller 33.

As illustrated in FIG. 5, a stopper 18 is disposed in a predetermined position on an under side of the feeding holder 17 on the apparatus body 201*a* side. The pickup roller 31 is supported via the feeding holder 17 that is pivotable around the rotation shaft 32*a* of the conveyance roller 32. As illustrated in FIG. 5, the rotation of the feeding holder 17 is regulated by the stopper 18 and the pickup roller 31 is prevented from being lowered below a predetermined position.

The sheet feeding apparatus 53 has a set tray 88 extending from a bottom portion of the second sheet storage portion 55*b* to the first sheet storage portion 55*a* side. A height of an upper surface of the set tray 88 on the second sheet storage portion 55*b* side is equal to a height of an upper surface of the lifter plate when lowering the lifter plate 35. That is, the set tray 88 is configured such that the lifter plate can smoothly move the sheet bundle from the set tray 88 to the lifter plate. A sheet bundle moving member 37 is disposed in the second sheet storage portion 55*b* as a sheet transfer portion. The sheet bundle moving member 37 is configured so as to extrude the sheet bundle (P) set in the second sheet storage portion 55*b* to the first sheet storage portion 55*a* when the sheet feeding cassette 93 is in the mounting position. The sheet bundle moving member 37 is able to be slidably moved in the rightward and leftward direction of FIGS. 2A to 4B by a drive force of a sheet bundle moving motor 65 (hereinafter bundle moving motor 65, see FIG. 8) controlled by the control portion 67.

In the following description, when describing a position of the sheet bundle moving member 37, a case of a position closer to the first sheet storage portion 55*a* than to the second sheet storage portion 55*b* is described as the first sheet storage portion 55*a* side and a case of a position closer to the second sheet storage portion 55*b* than to the first sheet storage portion 55*a* is described as the second sheet storage portion 55*b* side.

As illustrated in FIGS. 2A to 5, an arm member 36 for partitioning the sheet bundle (P) stored in the first sheet storage portion 55*a* and the sheet bundle (P) stored in the second sheet storage portion 55*b* is disposed substantially in the center of the sheet feeding cassette 93. The arm member 36 is supported so as to be pivotable between a partition position and an open position by driving of a partition solenoid 20 (see FIG. 8). The partition position is a position for partitioning between the first sheet storage portion 55*a* and the second sheet storage portion 55*b* by protruding between the first sheet storage portion 55*a* and the second sheet storage portion 55*b*. The open position is a position for opening a sheet transfer path between the first and second sheet storage portions by being retracted from the partition position. When transferring the sheet bundle (P) stacked in the second sheet storage portion 55*b* on the left side to the first sheet storage portion 55*a* on the right side in FIG. 2A, the arm member 36 is moved from the partition position to the open position.

Figure 2A:
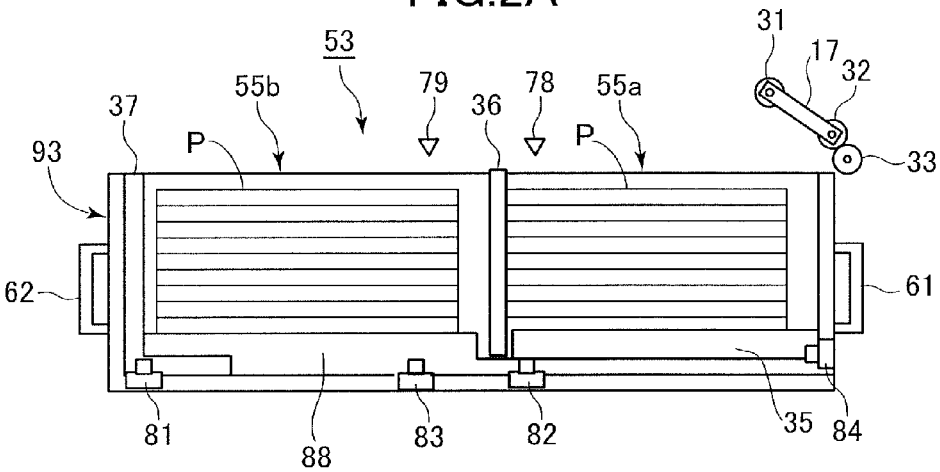
FIG. 2A is a schematic view illustrating a positional relationship between a pickup roller and sheets in a state in which a sheet feeding cassette according to the first embodiment is pulled out.
Figure 2B:
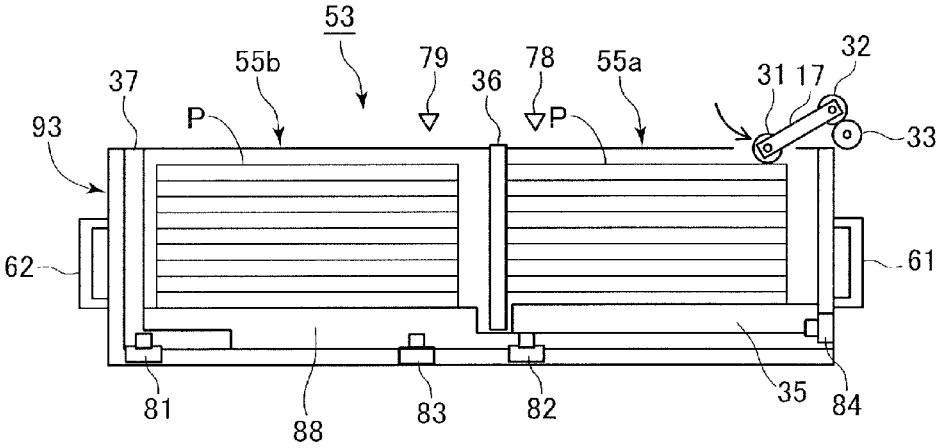
FIG. 2B is a schematic view illustrating a state in which the pickup roller is lowered after mounting the sheet feeding cassette.
Figure 2C:
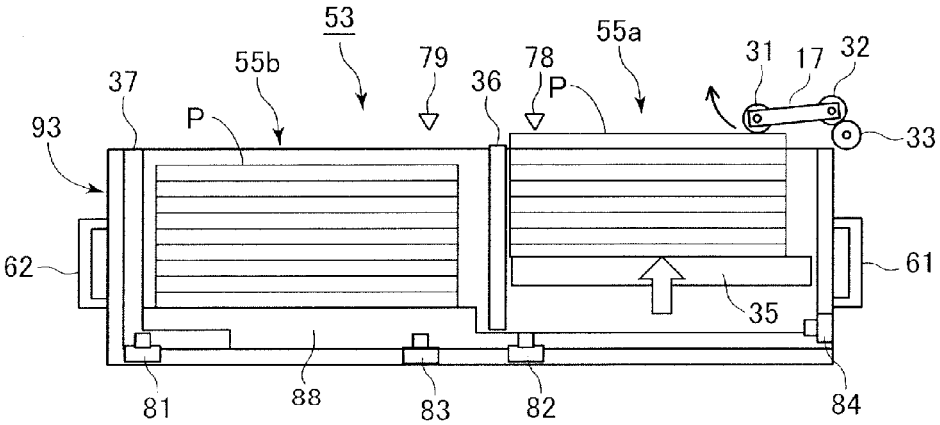
FIG. 2C is a schematic view illustrating a state in which the pickup roller is pushed up by lifting the sheets by a lifter plate.

As illustrated in FIGS. 2A to 2C, a sheet sensor 78 is disposed above the lifter plate 35 of the first sheet storage portion 55*a*. A sheet sensor 79 is disposed above the second sheet storage portion 55*b*. A sheet bundle moving member home position sensor 81 (hereinafter moving member HP sensor 81), a timing detection sensor (first detection portion) 83, a transfer completion detection sensor (second detection portion) 82, and a lifter HP sensor 84 are disposed on a bottom portion side of the sheet feeding cassette 93. The moving member HP sensor 81 is disposed on the left side of a lower portion of the second sheet storage portion 55*b* and the lifter HP sensor 84 is disposed on the right side of a lower portion of the first sheet storage portion 55*a*. The timing detection sensor 83 is disposed in a moving path of the sheet bundle moving member 37. The transfer completion detection sensor 82 is disposed at an end point of the moving path of the sheet bundle moving member 37. The timing detection sensor 83 and the transfer completion detection sensor 82 detect a position of a detected portion 38 provided in the lower portion of the sheet bundle moving member 37 when transferring the sheet.

The sheet feeding apparatus 53 according to the embodiment lifts the lifter plate 35 if the sheets are present in the first sheet storage portion 55*a*. On the other hand, the sheet feeding apparatus 53 transfers the sheet bundle to the first sheet storage portion 55*a* side by operating the sheet bundle moving member 37 after lowering the lifter plate 35 if the sheets are depleted in the first sheet storage portion 55*a* and the sheet bundle is present in the second sheet storage portion 55*b*. In the embodiment, as illustrated in FIG. 5, a relationship between a height Ha and a height H is set to satisfy a relationship of Ha>H as long as a sheet positioned on the top portion among the transferring sheet bundle is not curled. The height Ha indicates a height from an upper surface of the lifter plate 35 to a lower portion of an outer peripheral surface of the pickup roller 31 when transferring the sheet bundle lowered to a lowermost portion within the sheet feeding cassette 93. The height H indicates a height from the upper surface of the lifter plate 35 to the uppermost sheet among the sheet bundle in the middle of the transfer of the sheet bundle. In addition, as described above, the height of the pickup roller 31 is regulated by the stopper 18. A full load index 96 indicating a full load position of the sheets P stacked in the lifter plate 35 is attached to an upper back side of the first sheet storage portion 55*a* in the sheet feeding cassette 93.

Figure 6A:
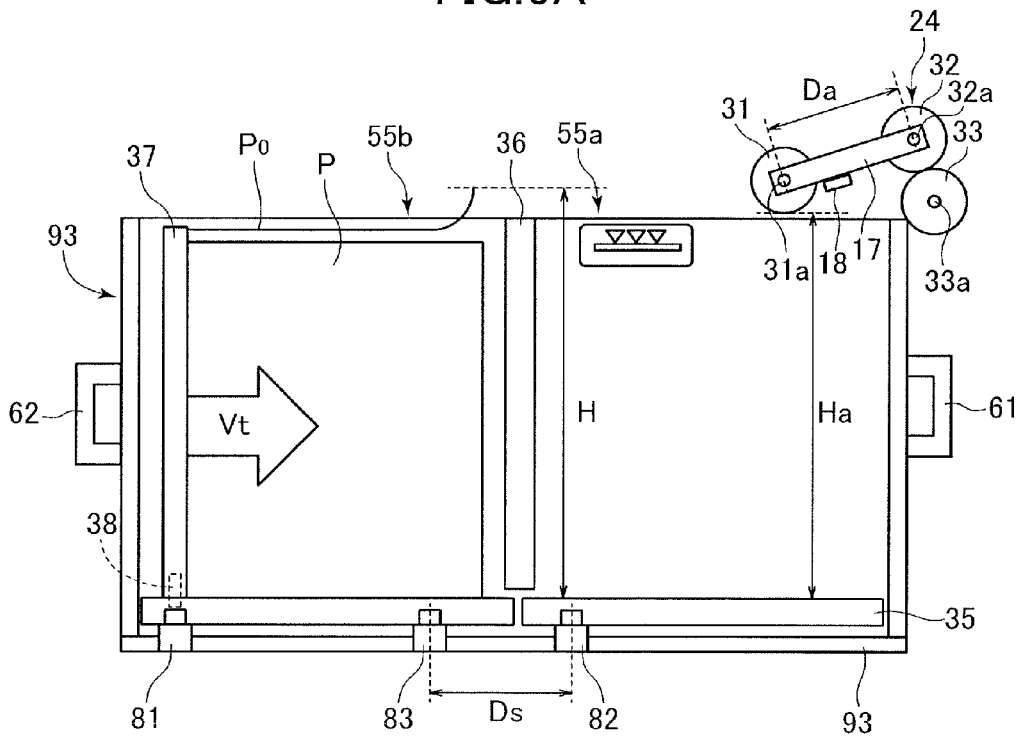
FIG. 6A is a schematic view illustrating a behavior of a curled sheet transferred to the first sheet storage portion side.
Figure 6B:
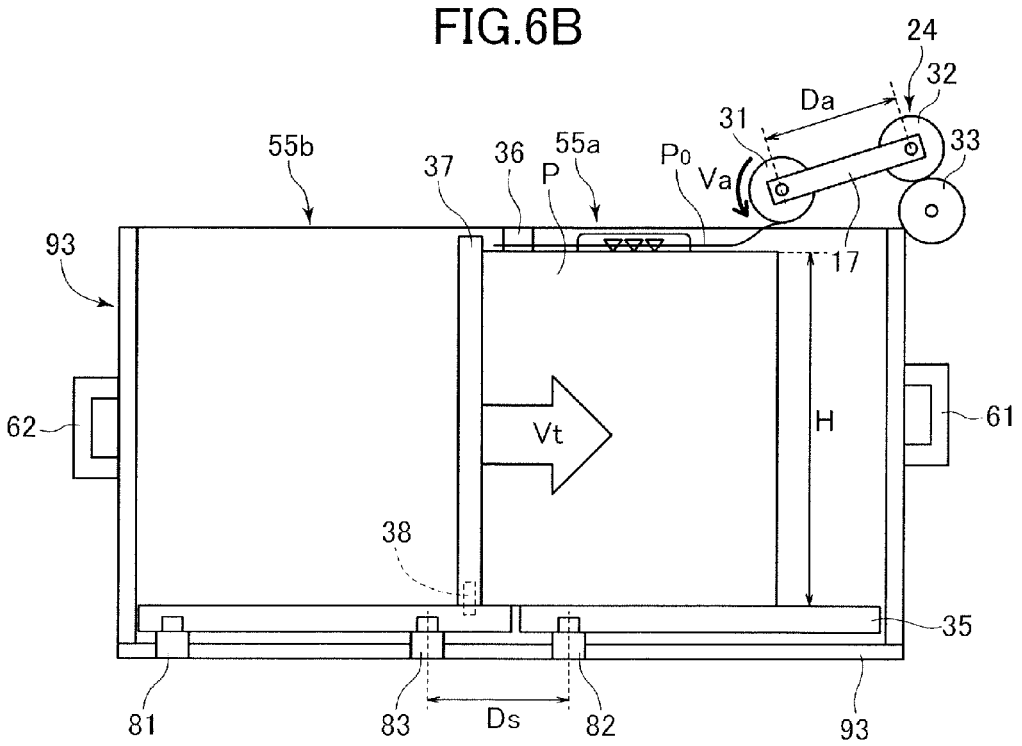
FIG. 6B is a schematic view illustrating a behavior of the curled sheet transferred to the first sheet storage portion side.
Figure 7A:
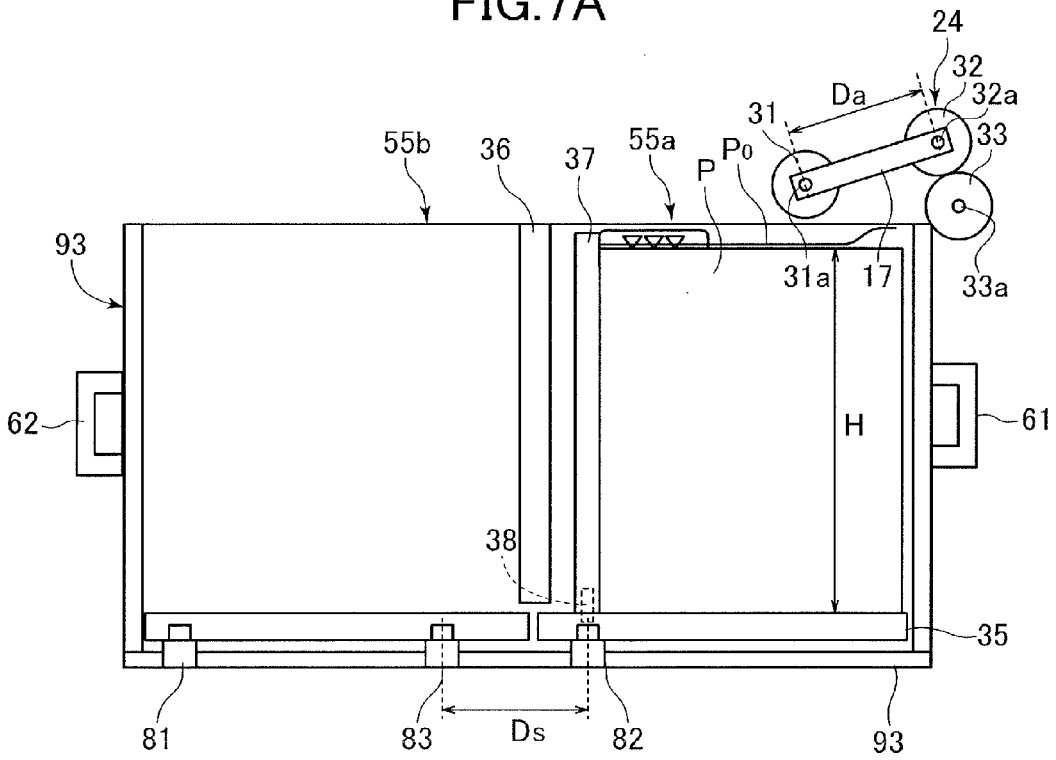
FIG. 7A is a schematic view illustrating a state of the curled sheet transferred to the first sheet storage portion side.
Figure 7B:
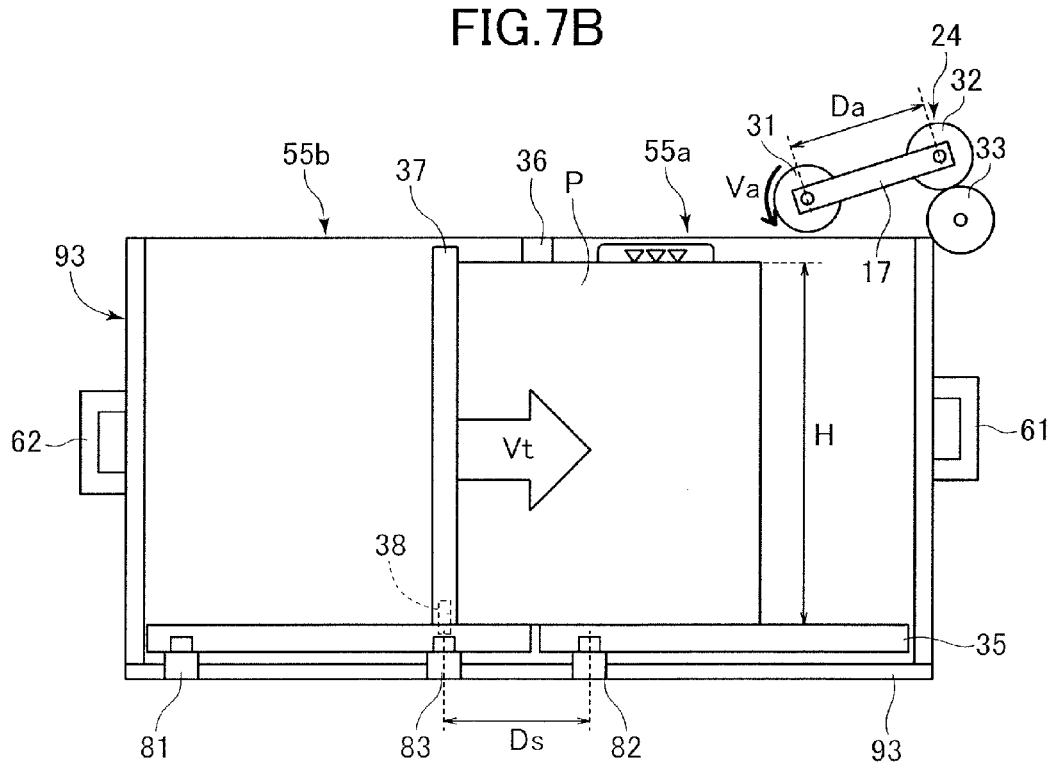
FIG. 7B is a schematic view illustrating positions of the pickup roller and the sheet bundle when a rotation of the pickup roller is started.

FIGS. 6A, 6B, and 7A are schematic views illustrating a behavior of the sheet in a case in which the top sheet is curled when transferring the sheet bundle from the second sheet storage portion side to the first sheet storage portion side. In FIGS. 6A, 6B, and 7A, for the sake of convenience, the lifter HP sensor 84 is omitted.

In FIG. 5, the pickup roller 31 is held above the top sheet when fully-loading the sheets in the second sheet storage portion 55*b*. However, as illustrated in FIG. 6A, in a case in which a top sheet ($P_0$) among the sheet bundle P that is set in the second sheet storage portion 55*b* is curled upward, a relationship between the heights of the pickup roller 31 and the sheet ($P_0$) is reversed. In this case, the top sheet $P_0$ comes into contact with the pickup roller 31 when the sheet bundle is transferred. When coming into contact with the pickup roller 31, a sheet that is to be originally guided on an under side of the pickup roller 31 may be guided on an upper side of the pickup roller 31. The sheet guided on the upper side of the pickup roller 31 cannot be appropriately fed when an image is formed. In addition, even if the sheet is not guided on the upper side of the pickup roller 31, a leading end of the curled sheet is further deformed by being pressed against the pickup roller 31 and, thereafter, it may interfere in sheet feeding in an image formation process. Then, in the embodiment, when transferring the sheet bundle, a device for rotating the pickup roller 31 in the same direction as a rotating direction (feeding direction) when feeding the sheet in the image formation process is provided. Therefore, as illustrated in FIG. 6B, even if the curled sheet $P_0$ comes into contact with the pickup roller 31 during the transfer of the sheet bundle, the pickup roller 31 is rotated in an arrow direction Va. Thus, the sheet $P_0$ is immediately guided on the underside of the pickup roller 31.

It is noted that the configuration of the embodiment is not limited to such a curled sheet and is also effective to an over load state in which the sheets P are loaded so as to be higher than a sheet full load position indicated by the full load index 96 in the second sheet storage portion 55*b*.

In the embodiment, when a moving velocity of the sheet bundle moving member 37 from the second sheet storage portion 55*b* side to the first sheet storage portion 55*a* side is defined as Vt and a peripheral rotation speed of the pickup roller 31 is defined as Va, the velocities are set to satisfy a relationship of Vt≤Va. The pickup roller 31 is rotated at the peripheral rotation speed Va equal to or greater than the moving velocity Vt of the sheet bundle moving member 37. Therefore, even if the sheet $P_0$ comes into contact with the pickup roller 31 during transferring, the sheet $P_0$ can be reliably guided on the underside of the pickup roller. Then, it is possible to complete the transfer of the sheet bundle when the curled sheet $P_0$ is in a preferred position as illustrated in FIG. 7A. This also applies to a second embodiment described below.

Furthermore, in the embodiment, when moving the sheet bundle moving member 37 from the second sheet storage portion 55*b* side to the first sheet storage portion 55*a* side by driving the bundle moving motor 65, the control portion 67 controls the members as follows. That is, in a case in which the curled sheet $P_0$ comes into contact with the pickup roller 31, the control portion 67 controls the transfer of the sheet bundle P to the first sheet storage portion 55*a* to be completed before the sheet $P_0$ reaches the conveyance roller (conveyance rotator) 32. Even in a case in which a relationship of Vt<Va is satisfied, if the peripheral rotation speed Va is too great with respect to the moving velocity Vt, the top sheet is delivered and may be fed into a nip portion between the conveyance roller 32 and the separating roller 33 by the roller 31 during the transfer of the sheet bundle. In the embodiment, such possibility is eliminated and a problem that the curled sheet is further bent between the pickup roller and the nip portion during the transfer does not occur. This also applies to the second embodiment described below.

For the sake of convenience, the moving velocity Vt of the sheet bundle moving member 37 from the second sheet storage portion 55*b* side to the first sheet storage portion 55*a* side is defined as Vt and the peripheral rotation speed of the pickup roller 31 is defined as Va. In addition, a distance between a rotation shaft (center of rotation) 31*a* (FIG. 5) of the roller 31 and the rotation shaft (center of rotation) 32*a* of the conveyance roller 32 is Da, and a distance between a sensor portion (detection portion) 83*a* of the timing detection sensor 83 and a sensor portion (detection portion) 82*a* of the transfer completion detection sensor 82 is Ds. In the embodiment, the velocities and the distances are set to satisfy a relationship of each of the following Expressions.

$$Vt \leq Va \quad (1)$$

$$Ds \leq Da \quad (2)$$

$$Ds/Vt = t \quad (3)$$

$$Va \times t < Da \quad (4)$$

Moreover, if Expression (3) and Expression (4) are summarized, it becomes the following.

$$Ds/Vt < Da/Va \quad (5)$$

The distances Ds and Da in Expression (2) are set in advance, and each condition of Expressions (1) and (5) is achieved by controls of a drive motor 50, the bundle moving motor 65, and the like described below by the control portion 67. A sheet bundle transfer time is equal to a pickup roller rotation time to rotate the pickup roller 31 during a transfer time between the timing detection sensor 83 and the transfer completion detection sensor 82.

Control System

Figure 8:
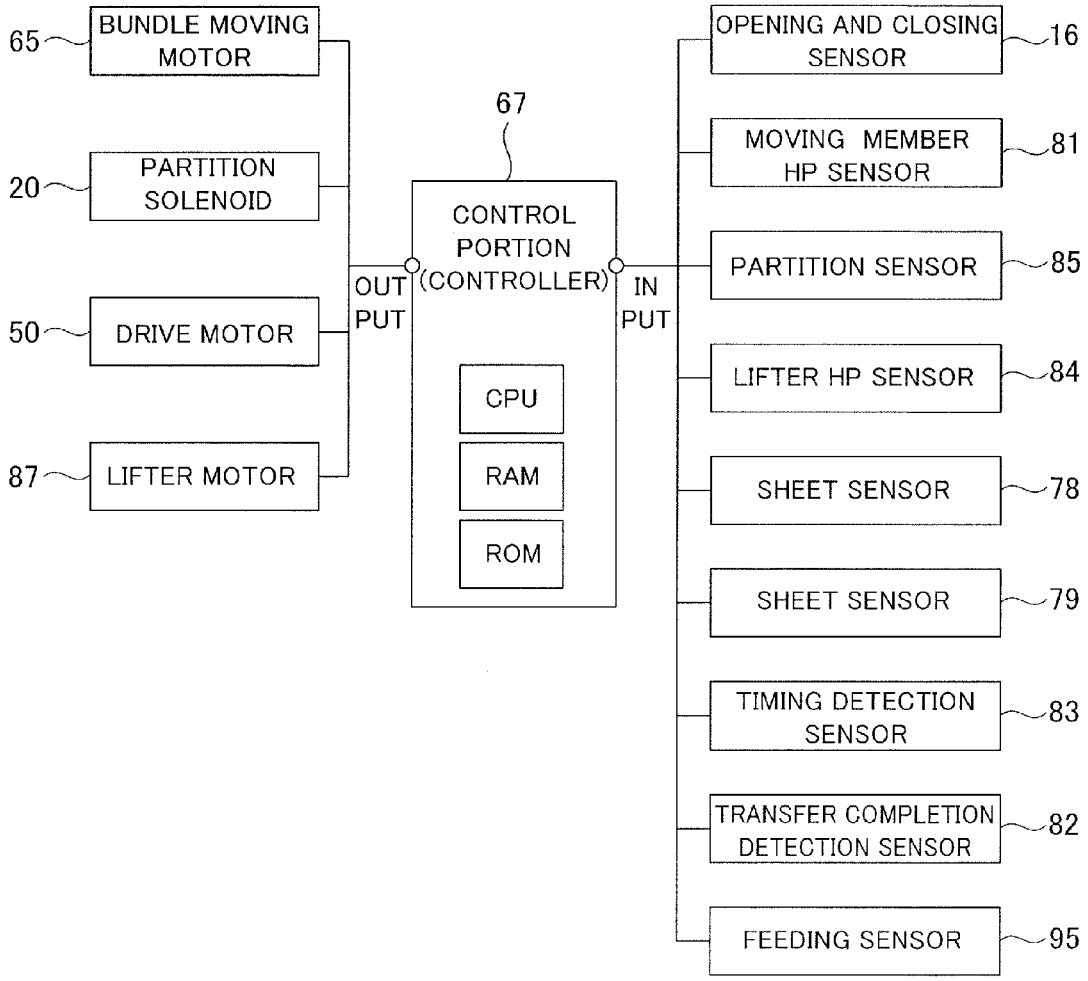
FIG. 8 is a block diagram illustrating a control system of a laser beam printer according to the first embodiment.

Next, a control system of the sheet feeding apparatus 53 according to the embodiment will be described with reference to FIG. 8. FIG. 8 is a block diagram illustrating elements included in the control system of the printer 201 according to the embodiment.

Hereinafter, each element will be described. As illustrated in FIG. 8, the control system includes the control portion 67 having a CPU, a RAM, and a ROM. An opening and closing sensor 16, the moving member HP sensor 81, a partition sensor 85, the lifter HP sensor 84, the sheet sensor 78, the sheet sensor 79, the timing detection sensor 83, the transfer completion detection sensor 82, and the feeding sensor 95 are connected to an input port of the control portion 67. The bundle moving motor (moving portion) 65, the partition solenoid 20, the drive motor (feeding drive unit) 50, and a lifter motor 87 are connected to an output port of the control portion 67. In addition, the control portion 67 executes display control for performing a predetermined display on an operation screen (not illustrated) included in the upper portion of the apparatus body 201*a*.

The opening and closing sensor 16 is configured of a photo-interrupter and detects whether the sheet feeding cassette 93 is in the mounting state on the apparatus body 201*a* or in the pull-out state in response to entry and retreat of a shielding plate (not illustrated) fixed to a rear surface of the sheet feeding cassette 93 between a light emitting portion and a light receiving portion (not illustrated). When a pull-out operation of the sheet feeding cassette 93 from the apparatus body 201*a* is detected by the opening and closing sensor 16, the pickup roller 31 is lifted in accordance with the pull-out operation of the sheet feeding cassette 93. Therefore, it is possible to pull out the sheet feeding cassette 93 in a state in which the pickup roller 31 is separated from the sheet P and to prevent deviation of the top sheet P stacked on the sheet feeding cassette 93.

The moving member HP sensor 81 (see FIG. 2A) detects that the sheet bundle moving member 37 is in a home position on the second sheet storage portion 55*b* side. The transfer completion detection sensor 82 (see FIG. 2A) detects completion of bundle moving by the sheet bundle moving member 37. When the sheet bundle moving member 37 is in the home position, a user can stack the sheet bundle on the second sheet storage portion 55*b*.

The partition sensor 85 detects whether the arm member 36 is in a partition position or an opening position by using the photo interrupter fixed to the sheet feeding cassette 93. The lifter HP sensor 84 is disposed in a lower portion of a front end of the sheet feeding cassette 93 and detects the home position of the lifter plate 35. The sheet sensor 78 is disposed above the lifter plate 35 of the first sheet storage portion 55*a* and detects presence or absence of the sheets P within the first sheet storage portion 55*a*. The sheet sensor 79 is disposed above the second sheet storage portion 55*b* and detects presence or absence of the sheet bundle P within the second sheet storage portion 55*b*.

The timing detection sensor 83 detects a rotation start timing of the pickup roller 31 based on the movement of the sheet bundle moving member to the first sheet storage portion 55*a*. The transfer completion detection sensor 82 detects the transfer completion of the sheet bundle (P) to the first sheet storage portion 55*a* side by the sheet bundle moving member 37 on the downstream side of the timing detection sensor 83.

The bundle moving motor (moving portion) 65 moves the sheet bundle moving member 37 from the second sheet storage portion 55*b* side to the first sheet storage portion 55*a* side in accordance with the control of the control portion 67 and thereafter, returns the sheet bundle moving member 37 from the first sheet storage portion 55*a* side to the second sheet storage portion 55*b* side. In addition, the partition solenoid 20 performs entry and retreat operations of a plunger (not illustrated) by moving the arm member 36 to the partition position or the opening position in accordance with the control of the control portion 67. The drive motor 50 is rotated in accordance with the control of the control portion 67, transmits a rotation to a drive transmitting coupling (not illustrated) via a gear train including pinions (not illustrated), and pivots the feeding holder 17 (see FIG. 5) around the rotation shaft 32*a* of the conveyance roller 32. In addition, the drive motor 50 is driven to rotate the pickup roller 31 in the feeding direction (arrow direction Va) in which the sheet is able to be fed by the control of the control portion 67. Since the feeding holder 17 is supported from an under side by the stopper 18, the pickup roller 31 is regulated so as not to be lowered from the position of FIG. 5 when transferring the sheet bundle from the second sheet storage portion 55*b* side to the first sheet storage portion 55*a* side. The lifter motor 87 moves the lifter plate 35 upward and downward in accordance with the control of the control portion 67.

Operation

Next, an operation of the sheet feeding apparatus in the embodiment will be described. A procedure of the transfer of the sheet from the second sheet storage portion 55*b* to the first sheet storage portion 55*a* after the sheet feeding cassette 93, in which the sheet bundles are stacked on both the first sheet storage portion 55*a* and the second sheet storage portion 55*b*, is mounted on the apparatus body 201*a* will be described.

First, as illustrated in FIG. 2A, in a state in which the sheet feeding cassette 93 is pulled out from the apparatus body 201*a*, the roller 31 is held in a high position, that is, a standby position (first position) so that the sheet P does not abut against the pickup roller 31 during mounting of the sheet feeding cassette 93. The sheet feeding cassette 93 is mounted on the apparatus body 201*a* and thereby if the opening and closing sensor 16 is turned on, the control portion 67 confirms that the sheet feeding cassette 93 is mounted on the apparatus body 201*a* and as illustrated in FIG. 2B, the feeding holder 17 is rotated and the pickup roller 31 is lowered. As described above, the rotation of the feeding holder 17 is regulated by the stopper 18 and the pickup roller 31 is not lowered from a predetermined position (second position).

Next, as illustrated in FIG. 2C, the control portion 67 operates the lifter motor 87 (FIG. 8) and lifts the lifter plate 35, and thereby the sheet P is lifted and the sheets push up the pickup roller 31. A flag (not illustrated) is provided in the feeding holder 17 and the flag is also moved if the pickup roller is pushed up. If the pickup roller 31 is in a position suitable for the feeding, the flag is detected by a feeding sensor 95. The control portion 67 stops the lifter motor 87 based on a detection signal of the feeding sensor 95. As described above, the control portion 67 adjusts the height of the lifter plate 35 by controlling the lifter motor 87 so that the uppermost sheet P of the sheet bundle is always stable and is fed by abutting against the pickup roller 31. The above is a procedure until a feed preparing completion in a case in which the sheet bundle (P) is present on the first sheet storage portion 55*a* side.

Figure 3A:
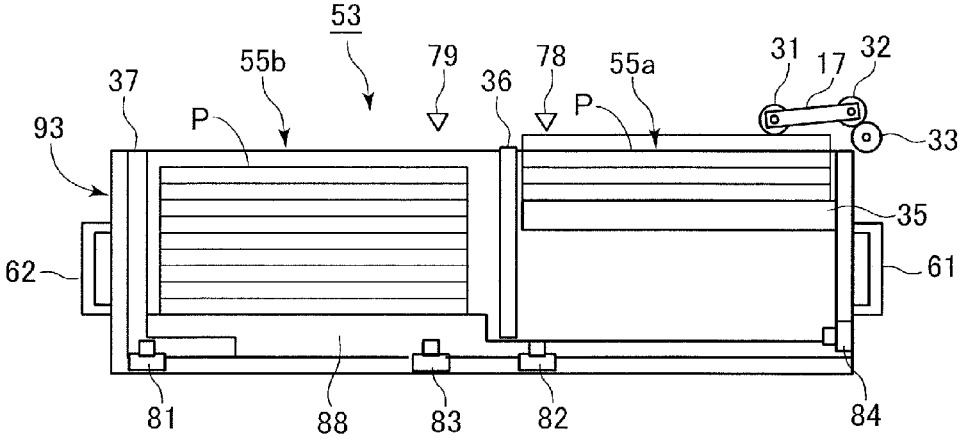
FIG. 3A is a schematic view illustrating a state in which a sheet bundle is in standby on a second sheet storage portion side during feeding the sheet by a first sheet storage portion.

Then, as illustrated in FIG. 3A, when performing image formation, the sheets P stacked on the lifter plate 35 are fed by the pickup roller 31 in order from above on the first sheet storage portion 55*a* side. In this case, the feeding sheet bundle (P) stacked on the set tray 88 is in standby on the second sheet storage portion 55*b* side.

Figure 3B:
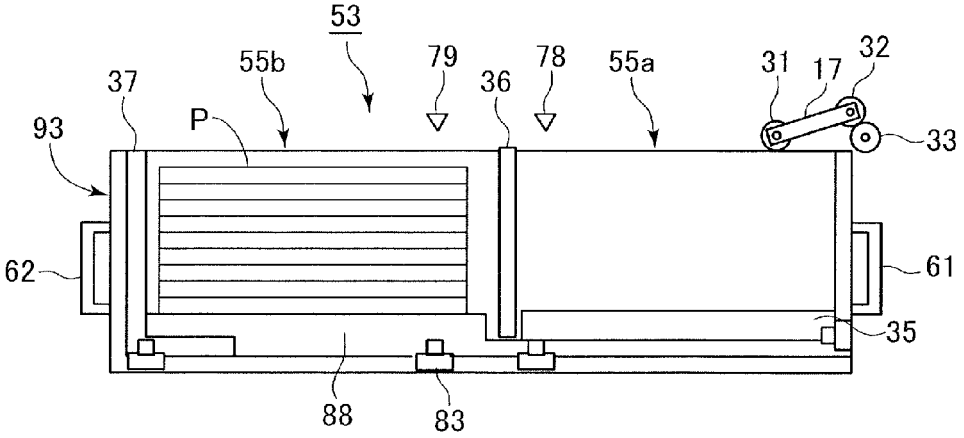
FIG. 3B is a schematic view illustrating a state in which the sheets of the first sheet storage portion are not present and the lifter plate is lowered.
Figure 3C:
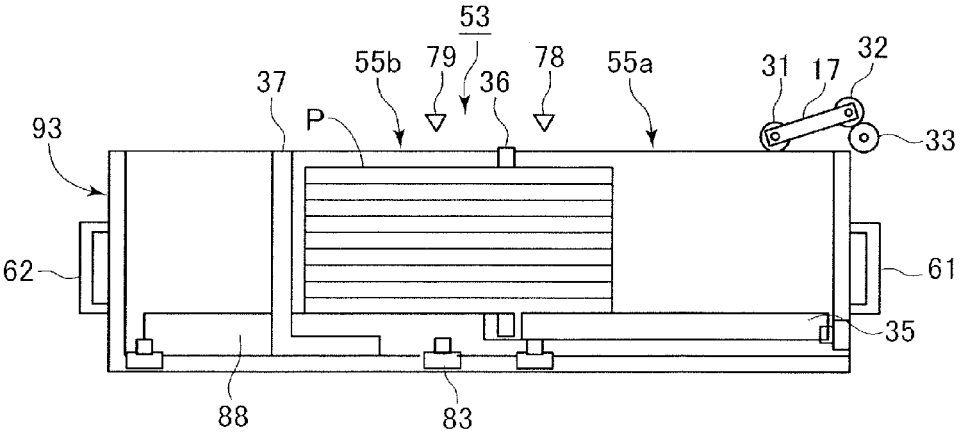
FIG. 3C is a schematic view illustrating a state in which the sheet bundle is in the middle of being transferred on the first sheet storage portion side.

Then, as illustrated in FIG. 3B, if the sheets are depleted on the first sheet storage portion 55*a* side, the lifter plate 35 is lowered. Thereafter, as illustrated in FIG. 3C, the sheet bundle (P) of the second sheet storage portion 55*b* is started to be transferred to the first sheet storage portion 55*a*. In addition, a transfer operation will be described with reference to FIGS. 5 to 7B and 9 later.

In addition, as illustrated in FIGS. 3C and 4A, the height of the pickup roller 31 during transferring is a position lower than a position (FIG. 2A) in which the sheet feeding cassette 93 is pulled out from the apparatus body 201*a*. As illustrated in FIG. 4A, if the transfer of the sheet bundle (P) to the first sheet storage portion 55*a* side is completed, as illustrated in FIG. 4B, the sheet bundle moving member 37 returns to the second sheet storage portion 55*b* side that is the home position. As illustrated in FIG. 4B, the lifter plate 35 is started to be lifted on the first sheet storage portion 55*a* side. The lifter plate is continuously lifted to a height suitable for performing the sheet feeding for the image formation by the pickup roller.

As described above, in the embodiment, after the sheets are depleted within the first sheet storage portion 55*a*, sheet supplement by the transfer is continuously and automatically performed. Thus, even if the sheets P are depleted on the first sheet storage portion 55*a* side, it is possible to continue the image formation process by transferring the sheet bundle (P) on the second sheet storage portion 55*b* side, which is set already, to the first sheet storage portion 55*a* without stopping the sheet feeding apparatus 53.

Figure 9:
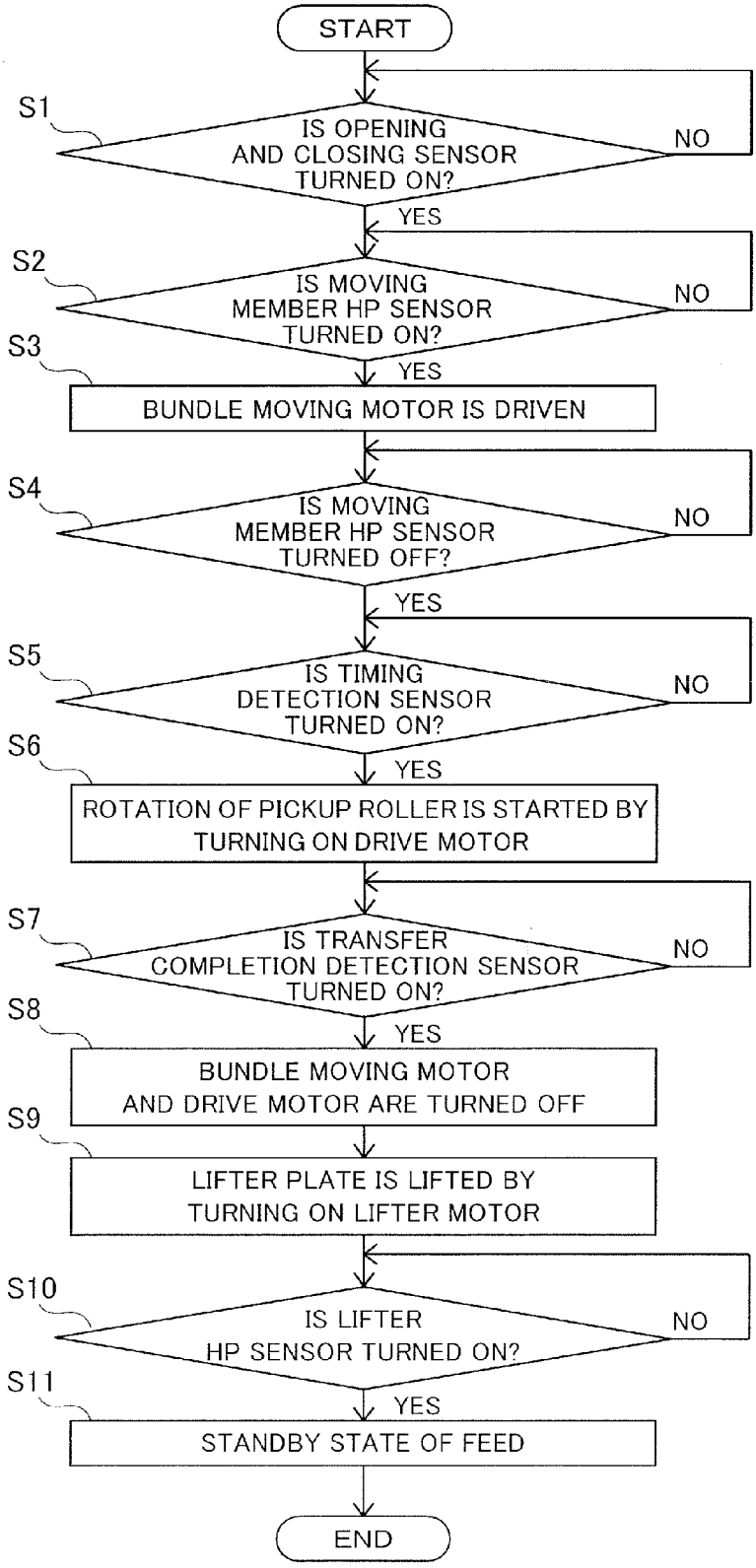
FIG. 9 is a flowchart illustrating an operation of a sheet feeding apparatus.
Figure 11:
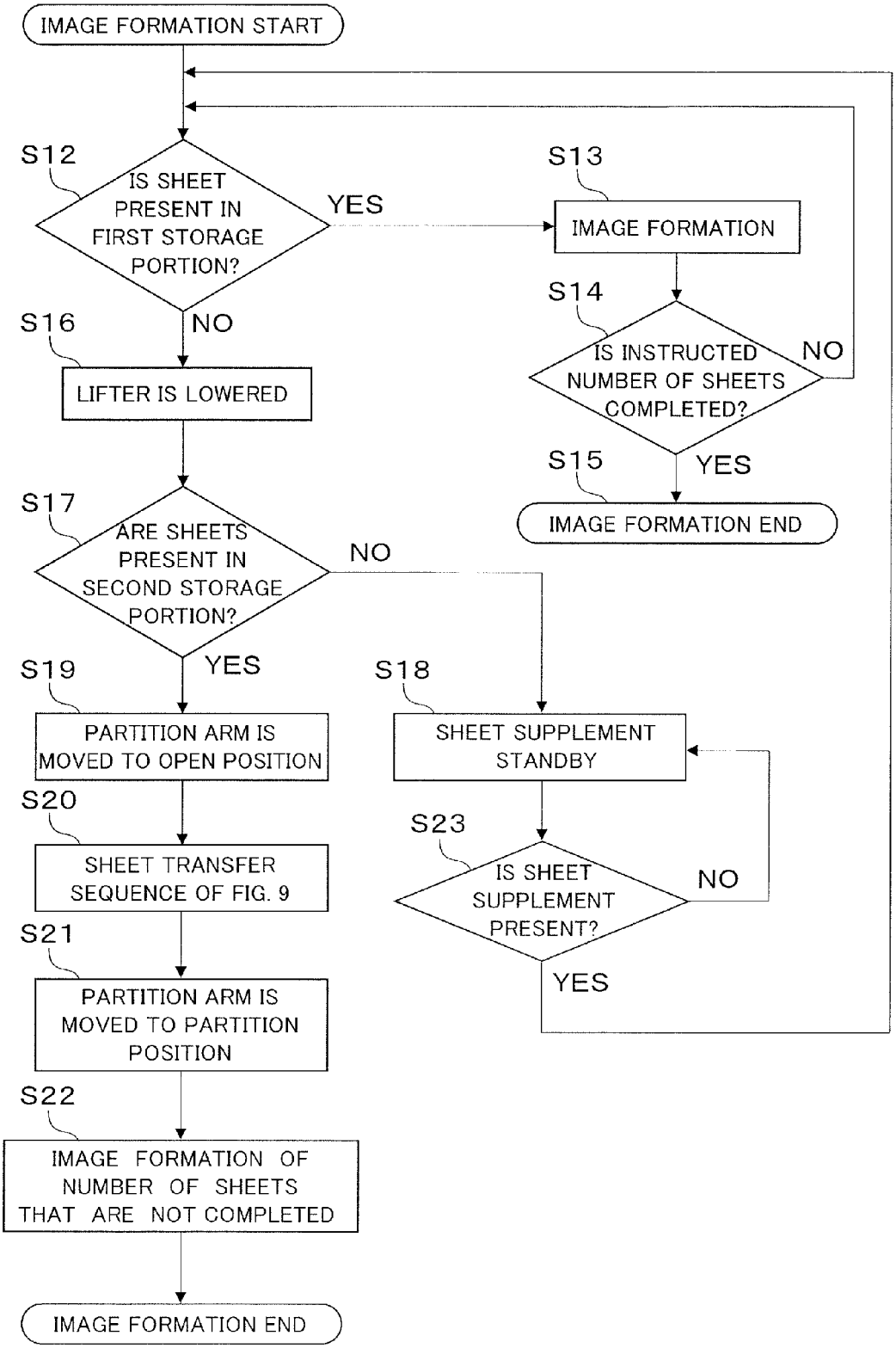
FIG. 11 is a flowchart illustrating an operation of the image forming apparatus.

Here, an operation of the image forming apparatus including the transfer operation described above will be described with reference to FIGS. 5, 6A, 6B, 7A, 7B, 9, and 11. It is noted that FIG. 9 is a flowchart illustrating an operation during transferring and that FIG. 11 is a flowchart illustrating the operation of the image forming apparatus. First, in the flowchart of FIG. 11, if image formation of an arbitrary number of sheets is instructed from an outside, the image forming apparatus starts the image formation. The control portion confirms whether or not the sheets are present in the first sheet storage portion (S12). If the sheets are present in the first sheet storage portion, the image formation is started, but if the sheets are run out in the first sheet storage portion before the image formation of the instructed number of sheets is completed, the control portion issues an instruction to lower the lifter (S16). Then, the control portion confirms whether or not the sheet bundle is present in the second sheet storage portion (S17). If the sheet bundle is depleted, it enters a sheet supplement standby state (S18). If the sheet bundle is present in the second sheet storage portion, the control portion issues an instruction to move the partition arm to the open position (S19). Then, the transfer operation illustrated in the flowchart of FIG. 9 is executed (S20).

That is, the control portion 67 confirms the mounting state of the sheet feeding cassette 93 based on the output signal of the opening and closing sensor (S1: YES) and then the sheet bundle moving member 37 being in the home position is confirmed by turning on state of the moving member HP sensor 81 (S2: YES). Then, the control portion 67 moves the sheet bundle moving member 37 from the second sheet storage portion 55*b* side illustrated in FIG. 6A to the first sheet storage portion 55*a* side illustrated in FIG. 6B by driving the bundle moving motor 65 (S3). Therefore, the sheet bundle (P) stored on the set tray 88 on the second sheet storage portion 55*b* side is collectively transferred to the first sheet storage portion 55*a* side and is supplied on the lifter plate 35 on the first sheet storage portion 55*a* side. Here, the control portion 67 confirms that the moving member HP sensor 81 is turned off and the sheet bundle moving member 37 is moved to the first sheet storage portion 55*a* side (S4: YES).

The control portion 67 confirms that the detected portion 38 of the sheet bundle moving member 37 passes through the position (FIG. 7B) of the sensor portion 83*a* based on turning on of the timing detection sensor 83 (S5: YES). The control portion 67 causes the rotation of the pickup roller 31 of a position $pl_2$ (FIG. 5) in the arrow direction Va to be started by driving the drive motor 50 at a time point (timing corresponding to a position $pl_1$ of FIG. 5) when the timing detection sensor 83 is turned on (S6). Even if the top sheet ($P_0$) of the sheet bundle transferred on the set tray 88 by the sheet bundle moving member 37 is curled upward, as illustrated in FIG. 6B, since the pickup roller 31 is rotated in the arrow direction Va, it is possible to guide the sheet $P_0$ on the underside of the pickup roller 31. Furthermore, it is possible to avoid jam during the image formation due to damage or further deformation of the leading end of the sheet $P_0$.

Furthermore, the control portion 67 confirms that the transfer of the sheet bundle to the first sheet storage portion side by the sheet bundle moving member 37 on the downstream side of the timing detection sensor 83 is completed based on turning on of the transfer completion detection sensor 82 (S7: YES). Then, the control portion 67 stops the rotation of the pickup roller 31. After returning the sheet bundle moving member 37 by reversing the bundle moving motor 65, the bundle moving motor 65 is turned off and the movement of the sheet bundle moving member 37 is stopped (S8). Furthermore, the control portion 67 lifts the lifter plate 35 by turning on the lifter motor 87 (S9). Therefore, the uppermost sheet on the lifter plate 35 abuts against the pickup roller 31 and the control portion 67 confirms that it is in a standby state in which the sheet is able to be fed (S11) at a time point when the lifter HP sensor 84 is turned on and the sheet is in the state of being able to be fed (S10: YES).

As already described in Expression (1), in the embodiment, when the moving velocity of the sheet bundle moving member 37 to the first sheet storage portion 55*a* side is Vt and the peripheral rotation speed of the pickup roller 31 is Va, the relationship therebetween is set to satisfy $Vt \leq Va$. Therefore, it is possible to guide the curled sheet to the underside of the pickup roller by the pickup roller 31 that is rotated at the peripheral rotation speed Va equal to or greater than the moving velocity Vt of the sheet bundle moving member 37. Therefore, it is possible to stably execute the transfer of the sheet bundle without damage of the sheet.

Furthermore, in the embodiment, when transferring the sheet P by the sheet bundle moving member 37, the control portion 67 controls the operation of each portion so as to satisfy the relationships of Expression (1), Expression (2), Expression (3), and Expression (4) described already based on the detection of the transfer completion detection sensor 82. Therefore, the control portion 67 stops the rotation of the pickup roller 31 and can control the transfer so that the transfer is completed by the sheet bundle moving member 37 before the leading end (see FIG. 7A) of the sheet $P_0$ reaches the conveyance roller 32. Therefore, it is possible to complete the transfer of the sheet bundle at a time point when the curled sheet $P_0$ is in a preferred position as illustrated in FIG. 7A without entering the nip portion between the conveyance roller 32 and the separating roller 33. As described above, in a series operation of the sheet bundle moving member 37 moving from the second sheet storage portion side to the first sheet storage portion side, it is possible to rotate the pickup roller 31 in the Va direction at an appropriate timing and to stop the rotation of the roller 31 at a time point when the transfer of the sheet bundle is completed.

In the embodiment, it is possible to guide the sheet P to the underside of the pickup roller during transferring. In addition, in the embodiment, the pickup roller 31 is rotated in the feeding direction in which the sheet is able to be fed only while the detected portion 38 is moved between the timing detection sensor 83 and the transfer completion detection sensor 82. That is, since the drive motor 50 is driven only in a necessary range, it is possible to contribute to energy saving and a reduction in operation noise.

Returning to FIG. 11, the control portion issues an instruction to move the partition arm to the partition position (S21). Then, the control portion issues an instruction to start again the image formation and the image forming apparatus performs the image formation by the number of sheets that are not completed (S22). According to the embodiment described above, even if the upper sheet of the sheet bundle stored in the second sheet storage portion is deformed due to curl and the like, it is possible to transfer the sheet bundle including the deformed sheet from the second sheet storage portion to the first sheet storage portion.

Second Embodiment

Figure 10:
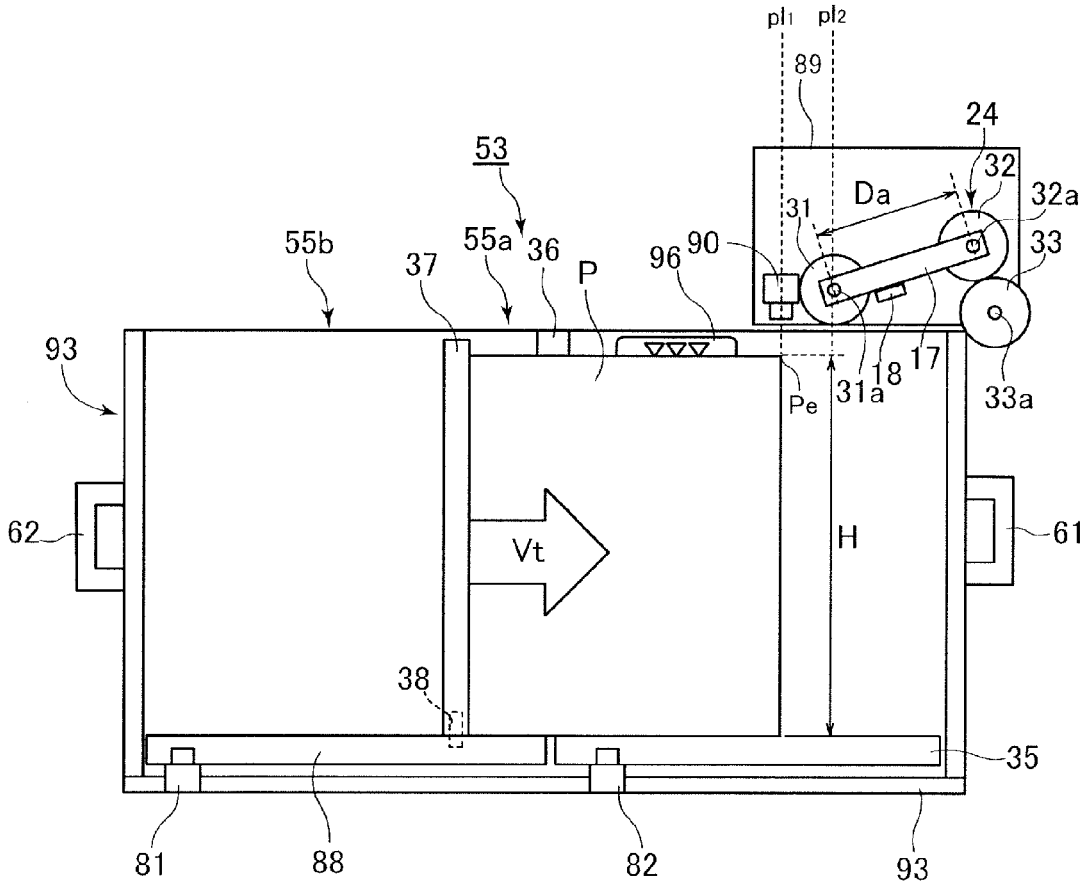
FIG. 10 is a schematic view illustrating a rotation start timing of the pickup roller of a second embodiment of this disclosure.

Next, a sheet feeding apparatus 53 of a second embodiment of this disclosure will be described with reference to FIG. 10. FIG. 10 is a schematic view illustrating a positional relationship of each portion at a rotation start timing of a pickup roller when transferring a sheet bundle. It is noted that, in the embodiment, the same reference numerals are given to the same members as the first embodiment and for the same configuration and function, that description thereof will be omitted.

As illustrated in FIG. 10, a feeding frame 89 is disposed above a lifter plate 35 on a first sheet storage portion 55*a* side. A timing detection sensor 90 of the embodiment, the pickup roller 31, the feeding holder 17, the stopper 18, and the sheet feeding portion 24 which are described above, and the like are disposed within the feeding frame 89. In the embodiment, the timing detection sensor 90 is disposed instead of the timing detection sensor 83 according to the first embodiment. The timing detection sensor 90 of the embodiment also configures a first detection portion for detecting the rotation start timing of the pickup roller 31. In the embodiment, a transfer completion detection sensor (second detection portion) 82 is in the same position as the transfer completion detection sensor 82 of the first embodiment and is able to detect a detected portion 38 of a sheet bundle moving member 37.

The timing detection sensor 90 can be configured of a reflection type optical sensor and is disposed in a position in which a sheet bundle P transferred by the sheet bundle moving member 37 can be detected. A control portion 67 drives a drive motor 50 so as to rotate the roller 31 before a leading end Pe of the sheet bundle P transferred by the sheet bundle moving member 37 reaches the position of the pickup roller 31. That is, the control portion 67 rotates the pickup roller 31 of which the center of rotation 31*a* is in a position $pl_2$ (FIG. 10) at a timing when the leading end Pe of the sheet reaches a position $pl_1$ (FIG. 10) of the timing detection sensor 90. That is, the control portion 67 can rotate the pickup roller 31 in a Va direction at an appropriate timing based on a detection signal from the timing detection sensor 90 detecting the leading end Pe of the sheet P in the transferring direction. In addition, even if the upper sheet of the sheet bundle transferred by the sheet bundle moving member 37 is curled upward, similar to the first embodiment, it is possible to guide the sheet on the underside of the pickup roller 31.

In the embodiment, it is possible to perform a start of the rotation of the pickup roller 31 based on the timing detection sensor 90 instead of the timing detection sensor 83 according to the first embodiment.

In the embodiment, the timing detection sensor 90 is also used as a sheet presence detection sensor for determining presence or absence of the sheets within the first sheet storage portion. It is possible to detect presence or absence of the sheets in the first sheet storage portion 55*a* while detecting the rotation start timing of the pickup roller 31. Therefore, in a case in which the sheets P are determined to be depleted within the first sheet storage portion 55*a* based on the detection of the timing detection sensor 90, the control portion 67 can control the feeding operation so as not to execute the feeding operation during the image formation.

In the second embodiment, similar to the first embodiment, the control portion 67 can control the transfer so as to complete the transfer by the sheet bundle moving member 37 before the leading end (see FIG. 7A) of the transferred sheet $P_0$ in the transferring direction reaches the conveyance roller 32. The control portion 67 can complete the transfer of the sheet bundle by stopping the rotation of the pickup roller 31 without causing the curled sheet $P_0$ to enter a nip portion between the conveyance roller 32 and the separating roller 33.

In addition, in the embodiment, since the timing detection sensor 90 is configured of the reflection type optical sensor, for the timing detection sensor 90, a member such as the detected portion 38 is not required and an apparatus configuration is simplified. In addition, in the second embodiment, the transfer completion detection sensor 82 is configured to detect the sheet bundle moving member 37, but similar to the timing detection sensor 90, may be disposed within the feeding frame 89 so as to detect the position of the sheet P. According to the embodiment described above, even if the upper sheet of the sheet bundle stored in the second sheet storage portion is deformed due to curl and the like, it is possible to transfer the sheet bundle including the deformed sheet from the second sheet storage portion to the first sheet storage portion.

It is noted that, in the first embodiment and the second embodiment, when performing the transfer of the sheet bundle, the control portion determines the rotation start timing and the rotation stop timing of the pickup roller 31 based on a signal from a sensor, but that other methods may be used. For example, a timer configured of hardware or software is provided in the control portion 67, an elapsed time after the transfer operation start is measured by the timer, and one of or both the rotation start timing and the rotation stop timing of the pickup roller 31 may be determined based on a measurement value. It is noted that, in the first embodiment and the second embodiment, the transfer portion of the type of pressing the sheet bundle by the sheet bundle moving member 37 is used, but that this disclosure is not limited to the embodiments. In a word, a mechanism which can transfer the sheet bundle from the second sheet storage portion to the first sheet storage portion may be provided and, for example, a type for sliding down the sheet bundle to the first sheet storage portion by lifting an end of the sheet tray may be used. Otherwise, a type for transferring the sheet bundle using a belt by providing the belt on a bottom surface of the second sheet storage portion may be used. It is noted that, in the first embodiment and the second embodiment, the laser beam printer 201 of the electrophotographic system is described, but that for example, an ink jet type image forming apparatus for forming an image on a sheet by ejecting ink liquid from nozzles may be used instead thereof. In addition, a thermal transfer type or other image forming apparatuses may be used.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiments of the present invention, and by a method performed by the computer of the system or apparatus by, for example, reading out and executing the computer executable instructions from the storage medium to perform the functions of one or more of the above-described embodiments. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-143750, filed Jul. 21, 2015 and Japanese Patent Application No. 2016-094913, filed May 10, 2016, which are hereby incorporated by reference herein in their entirety.

What is claimed is:

1. A sheet feeding apparatus comprising:

an apparatus body;

a first sheet storage portion configured to be movably provided to a mounting position and a pull-out position with respect to the apparatus body;

a second sheet storage portion disposed side by side with the first sheet storage portion and configured to be movably provided to the mounting position and the pull-out position with respect to the apparatus body;

a sheet transfer portion configured to transfer a sheet bundle stored in the second sheet storage portion to the first sheet storage portion when the first sheet storage portion and the second sheet storage portion are in the mounting position;

a rotator configured to feed a sheet by being rotated while abutting against the sheet stored in the first sheet storage portion in the same direction as a moving direction of the sheet transfer portion while transferring the sheet bundle stored in the second sheet storage portion to the first sheet storage portion;

a conveyance rotator provided downstream of the rotator in a sheet transferring direction and configured to convey the sheet fed by the rotator further downstream; and a control portion configured to control the sheet transfer portion and the rotator, the control portion being configured to execute a mode of rotating the rotator in the same rotation direction as that during feeding the sheet when transferring the sheet bundle of the second sheet storage portion to the first sheet storage portion by the sheet transfer portion and stopping the rotator before a leading end of the uppermost sheet of the sheet bundle reaches the conveyance rotator even if the uppermost sheet comes into contact with the rotator.

2. The sheet feeding apparatus according to claim 1, wherein the control portion causes the rotation of the rotator to be started before a leading end of the sheet bundle transferred by the sheet transfer portion reaches a position of the rotator in a sheet bundle transferring direction.

3. The sheet feeding apparatus according to claim 1, further comprising a first detection portion configured to detect a timing for starting of the rotation of the rotator and a second detection portion configured to detect a timing for stopping the rotation of the rotator, the control portion controls the rotator to be rotated based on a detection result of the first detection portion and to be stopped based on a detection result of the second detection portion.

4. The sheet feeding apparatus according to claim 1, wherein the control portion controls the sheet transfer portion and the rotator to satisfy a relationship of $Vt \leq Va$, where a moving velocity of the sheet transfer portion is Vt, and a peripheral rotation speed of the rotator is Va when transferring the sheet bundle of the second sheet storage portion to the first sheet storage portion.

5. The sheet feeding apparatus according to claim 3, further comprising a conveyance rotator configured to convey the sheet fed by the rotator further on a downstream side, wherein a relationship of $Ds \leq Da$ is satisfied, where a distance between a rotation center of the rotator and a rotation center of the conveyance rotator is Da, and a distance between a detection portion of the first detection portion and a detection portion of the second detection portion is Ds, and wherein the control portion controls Va and Vt when transferring the sheet bundle of the second sheet storage portion to the first sheet storage portion to satisfy a relationship of $Vt \leq Va$ and $Ds/Vt < Da/Va$, where a moving velocity of the sheet transfer portion is Vt and a peripheral rotation speed of the rotator is Va.

6. The sheet feeding apparatus according to claim 3, wherein the first detection portion and the second detection portion are provided in a transferring path of the sheet transfer portion and the second detection portion is disposed downstream of the first detection portion in a sheet bundle transferring direction.

7. The sheet feeding apparatus according to claim 3, wherein the first detection portion is configured to detect that the leading end of the sheet bundle transferred by the sheet transfer portion reaches a predetermined position.

8. The sheet feeding apparatus according to claim 3, wherein the first detection portion is configured to detect the timing for starting the rotation of the rotator and detect a presence or absence of the sheet of the first sheet storage portion.

9. The sheet feeding apparatus according to claim 3, wherein the first detection portion and/or the second detection portion detects a position of the sheet transfer portion.

10. The sheet feeding apparatus according to claim 1, wherein the rotator is configured to be moved to a first position and a second position that is lower than the first position, wherein the rotator is located in the first position in a case in which the first sheet storage portion and the second sheet storage portion are in the pull-out position, and wherein the rotator is located in the second position in a case in which the first sheet storage portion and the second sheet storage portion are in the mounting position.

11. An image forming apparatus comprising:

an apparatus body;

a first sheet storage portion configured to be movably provided to a mounting position and a pull-out position with respect to the apparatus body;

a second sheet storage portion disposed side by side with the first sheet storage portion and configured to be movably provided to the mounting position and the pull-out position with respect to the apparatus body;

a sheet transfer portion configured to transfer sheets stored in the second sheet storage portion to the first sheet storage portion when the first sheet storage portion and the second sheet storage portion are in the mounting position;

a rotator configured to feed a sheet by being rotated while abutting against the sheet stored in the first sheet storage portion in the same direction as a moving direction of the sheet transfer portion while transferring the sheet bundle stored in the second sheet storage portion to the first sheet storage portion;

a conveyance rotator provided downstream of the rotator in a sheet transferring direction and configured to convey the sheet fed by the rotator further downstream; and a control portion configured to control the sheet transfer portion and the rotator, the control portion being configured to execute a mode of rotating the rotator in the same rotation direction as that during feeding the sheet when transferring the sheets of the second sheet storage portion to the first sheet storage portion by the sheet transfer portion and stopping the rotator before a leading end of the uppermost sheet of the sheet bundle reaches the conveyance rotator even if the uppermost sheet comes into contact with the rotator; and an image forming portion configured to form an image onto the sheet fed by the rotator.

12. The image forming apparatus according to claim 11, wherein the image forming portion is a laser beam printer.

13. The image forming apparatus according to claim 11, wherein the image forming portion is an ink jet printer.

14. A sheet feeding apparatus comprising:

an apparatus body;

a first sheet storage portion configured to be movably provided to a mounting position and a pull-out position with respect to the apparatus body;

a second sheet storage portion disposed side by side with the first sheet storage portion and configured to be movably provided to the mounting position and the pull-out position with respect to the apparatus body;

a sheet transfer portion configured to transfer a sheet bundle stored in the second sheet storage portion to the first sheet storage portion when the first sheet storage portion and the second sheet storage portion are in the mounting position;

a rotator configured to feed a sheet by being rotated while abutting against the sheet stored in the first sheet storage portion;

a control portion configured to drive the sheet transfer portion and to control the rotator to be rotated in the same rotation direction as that during feeding the sheet when transferring the sheet bundle of the second sheet storage portion to the first sheet storage portion by the sheet transfer portion;

a first detection portion configured to detect a timing for starting of the rotation of the rotator and a second detection portion configured to detect a timing for stopping the rotation of the rotator, the control portion controlling the rotator to be rotated based on a detection result of the first detection portion and to the stopped based on a detection result of the second detection portion; and a conveyance rotator configured to convey the sheet fed by the rotator further on a downstream side, wherein a relationship of $Ds \leq Da$ is satisfied, where a distance between a rotation center of the rotator and a rotation center of the conveyance rotator is Da, and a distance between a detection portion of the first detection portion and a detection portion of the second detection portion is Ds, and wherein the control portion controls Va and Vt when transferring the sheet bundle of the second sheet storage portion to the first sheet storage portion to satisfy a relationship of $Vt \leq Va$ and $Ds/Vt < Da/Va$, where a moving velocity of the sheet transfer portion is Vt and a peripheral rotation speed of the rotator is Va.

15. An image forming apparatus comprising:

an apparatus body;

a first sheet storage portion configured to be movably provided to a mounting position and a pull-out position with respect to the apparatus body;

a second sheet storage portion disposed side by side with the first sheet storage portion and configured to be movably provided to the mounting position and the pull-out position with respect to the apparatus body;

a sheet transfer portion configured to transfer a sheet stored in the second sheet storage portion to the first sheet storage portion when the first sheet storage portion and the second sheet storage portion are in the mounting position;

a rotator configured to feed a sheet by being rotated while abutting against the sheet stored in the first sheet storage portion;

a control portion configured to drive the sheet transfer portion and to control the rotator to be rotated in the same rotation direction as that during feeding the sheet when transferring the sheets of the second sheet storage portion to the first sheet storage portion by the sheet transfer portion;

a first detection portion configured to detect a timing for starting of the rotation of the rotator and a second detection portion configured to detect a timing for stopping the rotation of the rotator, the control portion controlling the rotator to be rotated based on a detection result of the first detection portion and to be stopped based on a detection result of the second detection portion;

a conveyance rotator configured to convey the sheet fed by the rotator further downstream, wherein a relationship of $Ds \leq Da$ is satisfied, where a distance between a rotation center of the rotator and a rotation center of the conveyance rotator is Da, and a distance between a detection portion of the first detection portion and a detection portion of the second detection portion is Ds, and wherein the control portion controls Va and Vt when transferring the sheet bundle of the second sheet storage portion to the first sheet storage portion to satisfy a relationship of $Vt \leq Va$ and $Ds/Vt < Da/Va$, where a moving velocity of the sheet transfer portion is Vt and a peripheral rotation speed of the rotator is Va; and an image forming portion configured to form an image onto the sheet fed by the rotator.

* * * * *